US005314292A

United States Patent [19]

Holopainen

[11] Patent Number: 5,314,292

[45] Date of Patent: May 24, 1994

[54] MATERIAL CLAMPING APPARATUS

[76] Inventor: Vaino J. Holopainen, P.O. Box 806, Center Harbor, N.H. 03226

[21] Appl. No.: 953,486

[22] Filed: Sep. 29, 1992

[51] Int. Cl.[5] ..... B66C 23/54

[52] U.S. Cl. ..... 414/724; 37/406

[58] Field of Search ..... 414/686, 722, 724, 732, 414/729; 37/406

[56] References Cited

U.S. PATENT DOCUMENTS

| | | | |
|---|---|---|---|
| 3,991,890 | 11/1976 | Frank | 414/686 |
| 4,155,473 | 5/1979 | Holopainen | 414/722 X |
| 4,403,906 | 9/1983 | Holopainen | 414/724 |
| 5,111,602 | 5/1992 | Risch | 414/722 |
| 5,129,780 | 7/1992 | Stumpe | 414/686 |

*Primary Examiner*—Michael S. Huppert
*Assistant Examiner*—Donald W. Underwood
*Attorney, Agent, or Firm*—Blodgett & Blodgett

[57] ABSTRACT

A clamping apparatus for use on a material handling machine. The clamping apparatus includes a mounting bracket which is fixed to the material handling element of the machine, a connecting bracket which is pivotally mounted on the mounting bracket and a clamping arm which is pivotally mounted on the connecting bracket. The connecting bracket is pivotally mounted on the mounting bracket between an active position and a storage position. When the connecting bracket is in the active position, the clamp arm is hydraulically actuated within a vertical plane between an upper non-clamping position and a lower clamping position. When the connecting bracket is in the storage position, the clamp arm extends horizontally in an out of the way position. The connecting bracket is maintained in the active position by first retaining means and in the storage position by second retaining means.

2 Claims, 4 Drawing Sheets

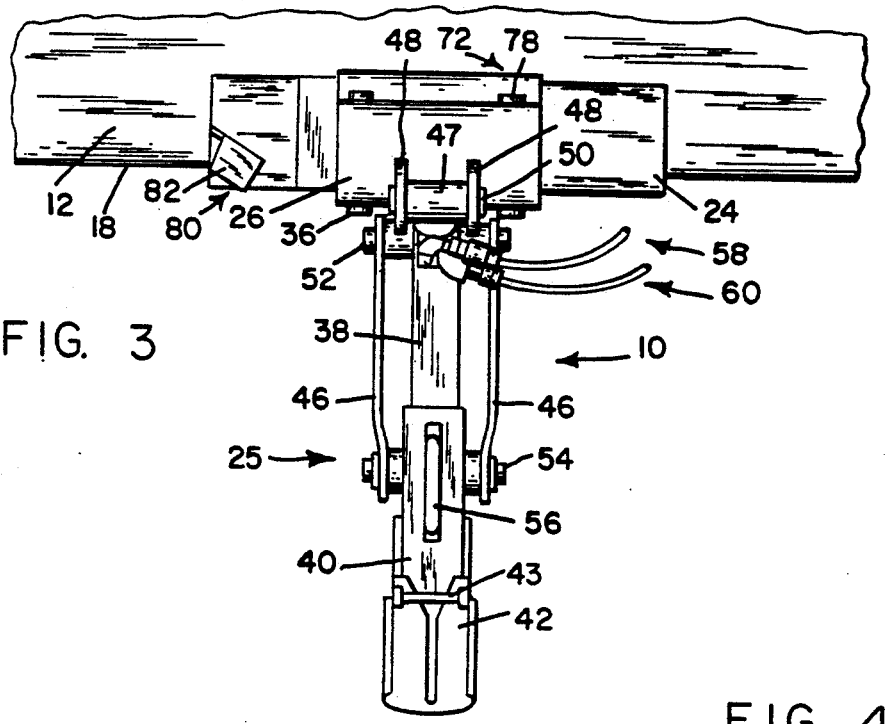
FIG. 3
FIG. 4
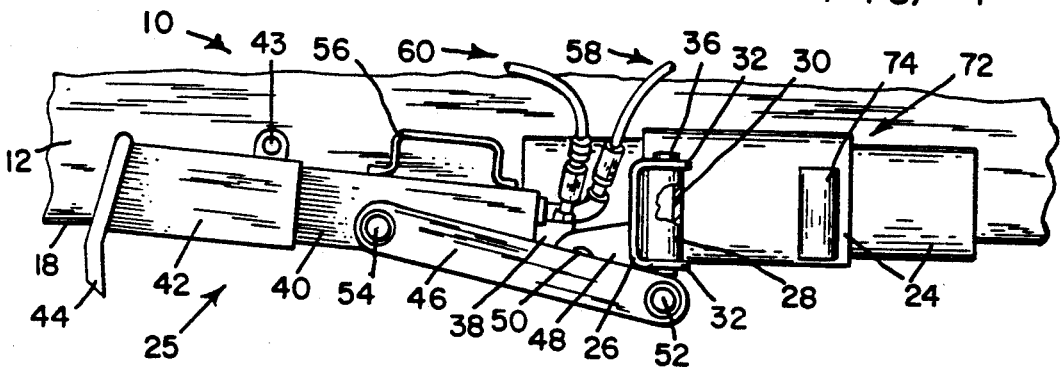
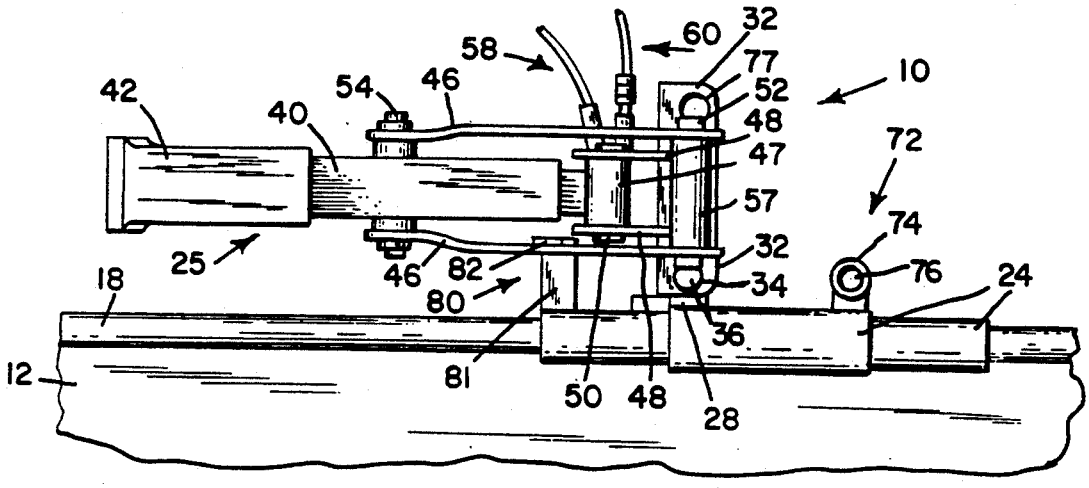
FIG. 5

FIG. 7
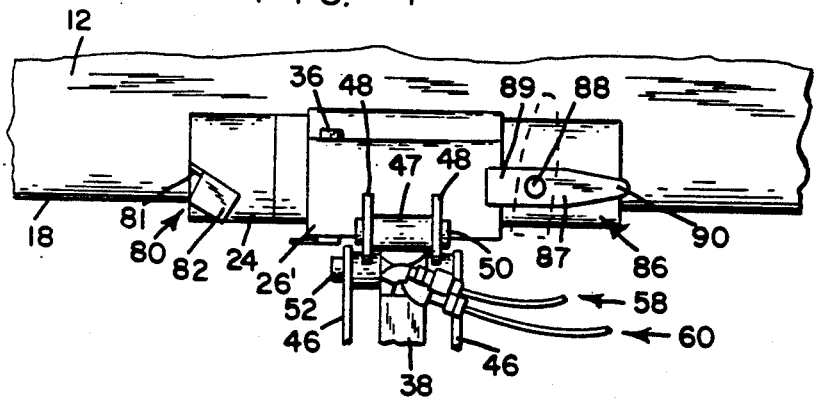
FIG. 9
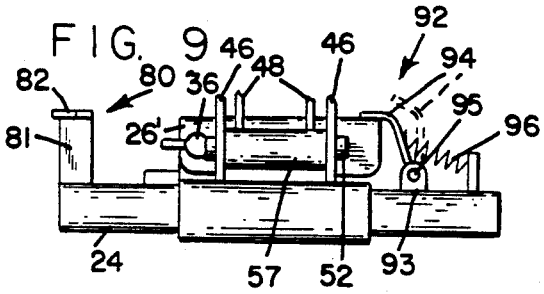
FIG. 8
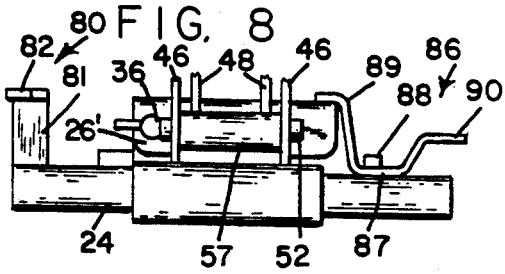
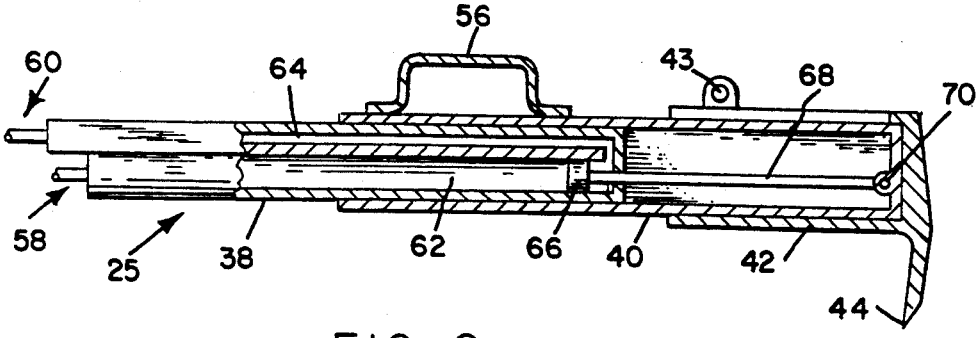
FIG. 6

MATERIAL CLAMPING APPARATUS

BACKGROUND OF THE INVENTION

The present application is generally directed to a material handling apparatus for use on the articulated material engaging member of a material handling machine, such as the blade of a bulldozer or the bucket of a front-end loader. The invention is particularly useful for enabling the machine to lift and carry large objects such as stones or logs and loose material such as bundles of brush or the like. The invention may also be used on other material handling machines, such as a forklift truck.

Although the bucket of a front-end loader has sufficient strength, there are many types of materials which are too awkward to be retained on the bucket. My prior U.S. Pat. Nos. 4,155,473 issued May 22, 1979, and U.S. Pat. No. 4,403,906 issued Sep. 13, 1983 each discloses a hydraulically actuated clamping apparatus for use on the bucket of a front-end loader for handling awkward objects or material. The mechanism which is shown in each of these patents is moved hydraulically within a vertical plane for movement between a non-clamping position above the top edge of the bucket and a clamping position adjacent the lower edge of the bucket for clamping material against the bucket. The mechanism can also be moved hydraulically within a vertical plane which is transverse to the vertical clamping plane for storage along the top edge of the bucket when the clamping mechanism is not in use.

The clamping mechanism of my prior U.S. Pat. No. 4,403,906 has the added advantage of having a telescoping clamping arm which is extendable for clamping functions and retractable for storage during non-use.

Although the hydraulically actuated elements for storing the clamping device in each of my prior two patents is convenient for the operator of the machine, it adds to the complexity and expense of the clamping apparatus. This function requires an additional connector to the hydraulic system. Some machines have limited connections and the connections may be needed for other hydraulic accessories. These and other difficulties experienced with the prior art clamping devices have been obviated in a novel manner by the present invention.

It is, therefore, a principle object of the present invention to provide a clamping apparatus from use on a material handling machine which can be manually retracted to a storage position with relative ease and which can be secured in either the active position or the storage position.

Another object of this invention is the provision of a clamping apparatus for use on a material handling machine which can be manually removed with relative ease from the machine for storage during extended periods of non-use.

A further object of the present invention is the provision of a clamping apparatus for use on the material handling machine which is simple, rugged in construction, and which is capable of a long life of useful service.

SUMMARY OF THE INVENTION

The invention consists of a clamping apparatus for use on a material handling machine such as a front-end loader. The clamping apparatus includes a mounting bracket which is fixed to the material handling members, such as the bucket of a tractor or front-end loader, a connecting bracket which is pivotally mounted on the mounting bracket and elongated clamp arm which is pivotally mounted on the connecting bracket. The elongated clamp arm is hydraulically actuated between an upper and active position to a lower planting position. The connecting bracket is mounted on the mounting bracket for movement between a horizontal active position to a vertical inactive position wherein the clamping arm extends horizontally just above the upper edge of the bucket. The connecting bracket is maintained in the active position by first retaining means and in the inactive position by second retaining means.

BRIEF DESCRIPTION OF THE DRAWINGS

The character of the invention, however, may be best understood by reference to one of its structural forms, as illustrated by the accompanying drawings, in which:

FIG. 3 is a plan view of the material clamping apparatus shown in the clamping position, FIG. 4 is a plan view of the clamping apparatus shown in the storage position, FIG. 5 is a front elevational view of the clamping apparatus shown in the storage position, FIG. 6 is a longitudinal cross-sectional view of the clamping arm of the present invention, FIG. 7 is a fragmentary plan view showing a first modified retaining mechanism for the connecting bracket, FIG. 8 is a fragmentary front elevational view of the first modified retaining mechanism, FIG. 9 is a fragmentary front elevational view of a second modified retaining mechanism for the connecting bracket.

DETAILED DESCRIPTION OF THE PREFERRED EMBODIMENT

Figure 1:
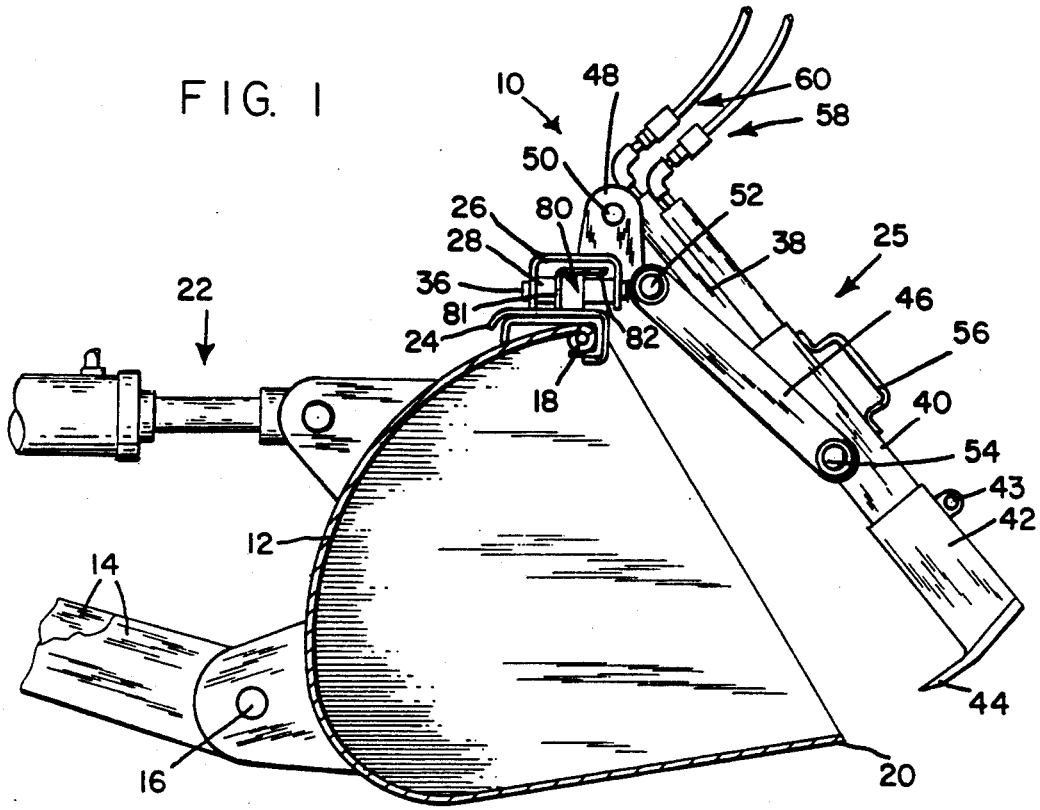
FIG. 1 is a side elevational view of the material handling apparatus of the present invention shown mounted on the bucket of a front end loader and in a material clamping position.
Figure 2:
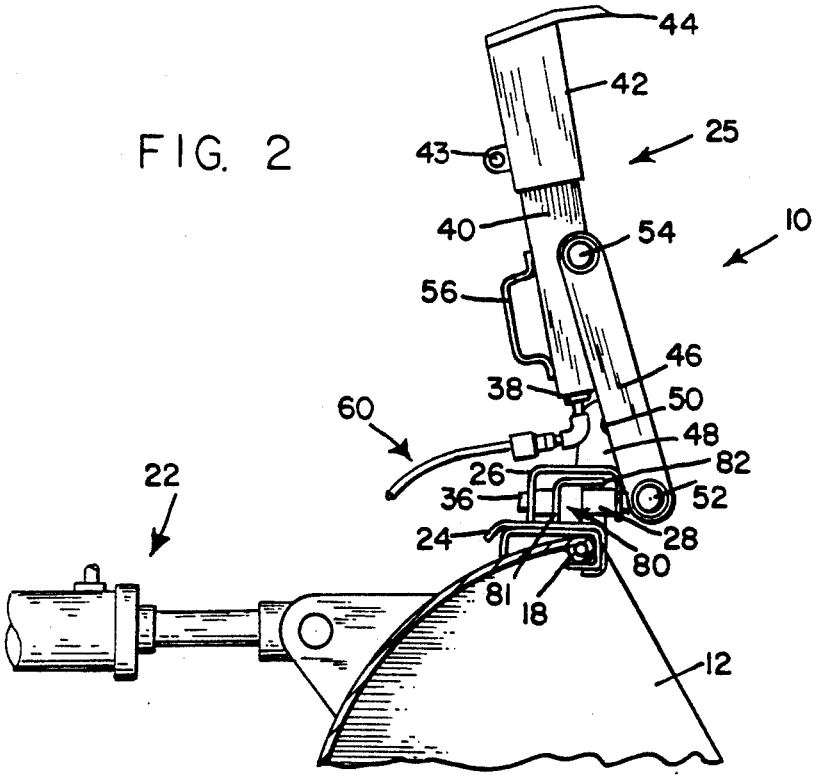
FIG. 2 is a view similar to FIG. 1 showing the clamping arm in the raised non-clamping position.

Referring first to FIGS. 1 and 2, the material clamping apparatus of the present invention is generally indicated by the reference numeral 10 and is shown attached to a bucket 12 of a front end loader, not shown. The bucket 12 is attached to the front end loader by lift arms 14 which are pivotally connected to the bucket by pivot pins 16. The bucket 12 is mounted for rotation about a horizontal axis which extends through the pivot pins 16. The bucket is pivoted by hydraulic actuating means, generally indicated by the reference numeral 22. The forwardly facing side of the bucket 12 has an upper horizontal edge 18 and a lower horizontal edge 20.

The material clamping apparatus 10 comprises a mounting bracket 24 which is fixed to the top edge 18 of the bucket 12, a connecting bracket 26 which is pivotally connected to the mounting bracket 24 and an elongated clamp arm which is generally indicated by the reference numeral 25 and which is pivotally connected to the connecting bracket 26.

Referring to FIGS. 1-5, the mounting bracket 24 has a cylindrical flange 28 which extends between a pair of spaced flanges 32 of the connecting bracket 26, each flange 32 has a bore 34 which is axially aligned with a bore 30 of the flange 28. A pivot pin 36 extends through the bores 30 and 34 to enable the connecting bracket 26 to pivot relative to the mounting bracket 24 about the horizontal axis of the connecting pin 36. The connecting bracket 26 is able to pivot from a horizontal active position as shown in FIG. 3 to a vertical storage position as shown in FIGS. 4 and 5, wherein the clamp arm 25 extends just above the top edge 18 of the bucket.

The elongated clamp arm 25 comprises a first part 38 which is pivotally connected to the connecting bracket 26 and a second part 40 which is telescopingly mounted on the first part 38. The outer end of the second part 40 is provided with a boot 42 which has a rearwardly extending grasping finger 44 when the clamp arm is in its active clamping position as shown in FIG. 1. The boot 42 is telescopingly mounted on the second part 40 and clamped in a fixed position relative to the part 40 by a bolt 43. The boot 42 can be moved longitudinally relative to the part 40 by loosening the bolt 43 to change the effective length of the clamp arm 25 to accommodate a plurality of bucket sizes. A pair of rigid links 46 are pivotally connected to the connecting bracket 26 by means of a pivot pin 52. The opposite end of each link 46 is pivotally connected to the second part 40 of the clamp arm by a pair of pivot pins 54. The rear end of the second part 40 has a tubular knuckle 47 which is rotatably mounted on a pin 50 which extends between a pair of spaced flanges 48 that form part of the connecting bracket 26. A handle 56 is located on the second part 40. A pair of hydraulic connectors, generally indicated by the reference numerals 58 and 60, are operatively connected to the clamp arm 25 for hydraulically moving the second part 40 relative to the first part 38. The inner ends of the arms 46 are located at opposite ends of a tubular member 57 which is fixed to the flanges 48. The pivot pin 52 extends through an aperture in each of the arms 46 and through the member 57.

Referring particularly to FIG. 6, the first part 38 has a bore 62 and a bore 64. A piston 66 is slidably mounted within the bore 62 and is connected to a connecting rod 68 which is pivotally connected by a pivot pin 70 to the outer end of a second part 40. When hydraulic fluid within the bore 64 is pressurized, the piston 66 moves inwardly along the bore 62 which causes the second part 40 to retract along the first part 38. When the hydraulic fluid within the bore 62 is pressurized, the piston 66 moves outwardly toward the second part 40, thereby causing the second part 42 moved to its extended position relative to the first part 38 as shown, for example, in FIG. 6. When the second part 40 is in its retracted position, it assumes the upper non-clamping position shown in FIG. 2. When the second part 40 is moved to its extended position, the rigid links 46 cause the clamp arm assembly 25 to moves to its material clamping position as shown in FIG. 1.

The connecting bracket 26 is maintained in its active position by first retaining means, generally indicated by the reference numeral 72. When the connecting bracket is in its horizontal active position, the clamp arm 25 can be selectively moved between its upper non-clamping position as shown in FIG. 2 to its lower clamping position as shown in FIG. 1. The first retaining means 72 comprises a tubular flange 74 which is fixed to the mounting bracket 24 and which has a horizontal bore 76. Each of the flanges 32 has a bore 77 and which is axially aligned with the bore 76 when the connecting bracket is in the horizontal position as shown in FIG. 3. A removable connecting pin 78 extends through the bores 77 and 76 to retain the connecting bracket 26 in its horizontal or active position. When the clamping apparatus 10 is not being utilized, the pin 78 is removed and the connecting bracket 26 is rotated about the connecting pin 36 to its vertical or inactive position as shown in FIGS. 4 and 5, wherein the clamp arm 25 lies just above the top edge 18 of the bucket in its retracted state as shown in FIGS. 4 and 5. The clamping apparatus 10 is maintained in its stored position by a second retaining means which is generally indicated by the reference numeral 80. The retaining means 80 is an L-shaped element having a vertical leg 81 which is fixed to the mounting bracket 24 and a horizontal leg 82 which extends forwardly from the top of the vertical leg 81. When the material clamping apparatus 10 is moved to its stored position, one of the links 46 extends beneath the horizontal leg 82 to prevent the apparatus from pivoting about the connecting pin 36. When the clamping apparatus 10 is moved from the active position shown in FIG. 3 to the stored position shown in FIGS. 4 and 5, the elongated clamping arm is partially extended so that the links 46 are in front of the retain means 80. As the clamp arm 25 is retracted, one of the links 46 passes beneath the horizontal leg 82 of the second retaining means so that the material clamping apparatus 10 is prevented from rotating about the connecting pin 36. When the clamping apparatus 10 in the storage position, it is in a retracted or compact state and located just above the top edge of the bucket where it does not interfere with the normal operation of the bucket for tasks which do not require the use of the clamping apparatus. If the bucket is to be used for extended periods which do not require the use of the clamping apparatus, it may be desirable to remove the clamping apparatus all together. This is accomplished by removing the connecting pin 36 from the bores 30 and 34. This enables the elongated clamp arm and the connecting bracket to remove completely from the mounting bracket 24 and stored at an appropriate storage facility.

FIRST MODIFIED RETAINING MEANS

Referring to FIGS. 7 and 8, there is shown a first modified first retaining means, generally indicated by the reference numeral 86. The retaining means 86 includes a base portion 87 which is pivotally connected to the mounting bracket 24 by a pivot pin 88, and an L-shaped flange 89 which extends upwardly from the base portion 87 and extends horizontally over a connecting bracket 26'. A handle portion 90 extends from the base portion 87 in the opposite direction from the flange 89. The connecting bracket 26' is fixed to the mounting bracket 24 and is identical to the connecting bracket 26 except that it does not have the bore 76. When the modified retaining means 86 is at the full line position as shown in FIGS. 7 and 8, the flange 89 overlies the connecting bracket 26' and prevents the connecting bracket from pivoting about the connecting pin 36. When the retaining means 86 is rotated about the pivot pin 88 to the dotted line position as shown in FIG. 7, the flange 89 is clear of the connecting bracket 26' so that the connecting bracket is free to pivot about the connecting pin 36 for enabling the clamping apparatus to be moved to its storage position as shown for example in FIGS. 4 and 5.

SECOND MODIFIED RETAINING MEANS

Referring to FIG. 9, a second modified first retaining means is generally indicated by the reference numeral 92 and comprises a bracket 93 which is fixed to the mounting bracket 24 and an L-shaped arm 94 which is pivotally connected to the bracket 93 by a pivot pin 95. The arm 94 is biased to its full line position as shown in FIG. 9 by a compression spring 96, wherein the horizontally extending portion of the arm 94 overlies the connecting bracket 26' and prevents the connecting bracket from rotating about the connecting pin 36. When the arm 94 is moved to its dotted line position, as shown in FIG. 9, against the compression spring 96, the connecting bracket 26' is free to pivot about the connecting pin 36 for enabling the clamping apparatus to be moved to its storage position.

Figure 10:
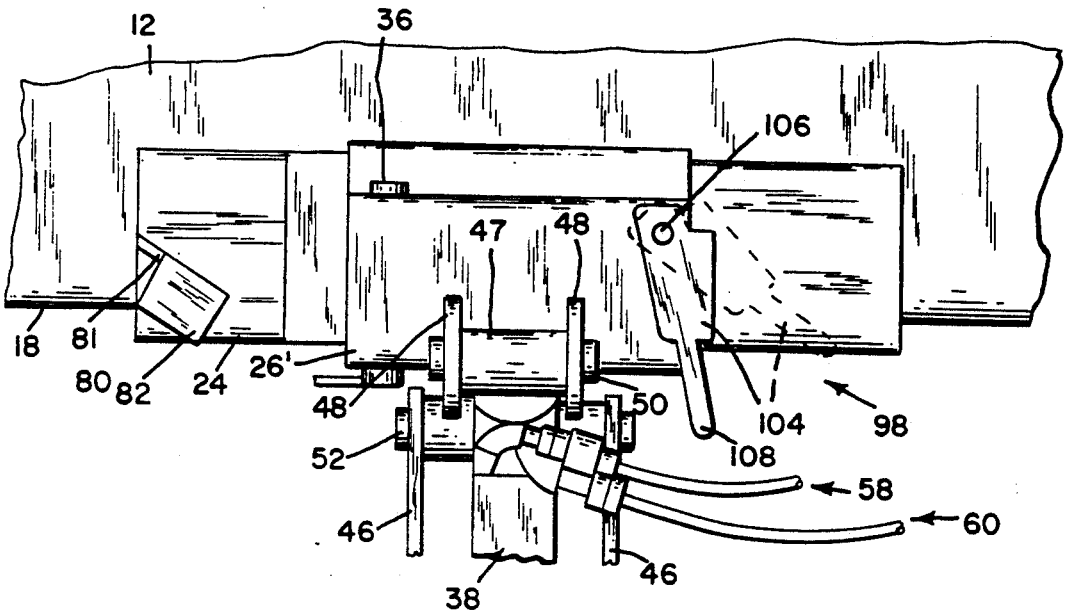
FIG. 10 is a fragmentary plan view showing a third modified retaining mechanism for the connecting bracket.
Figure 11:
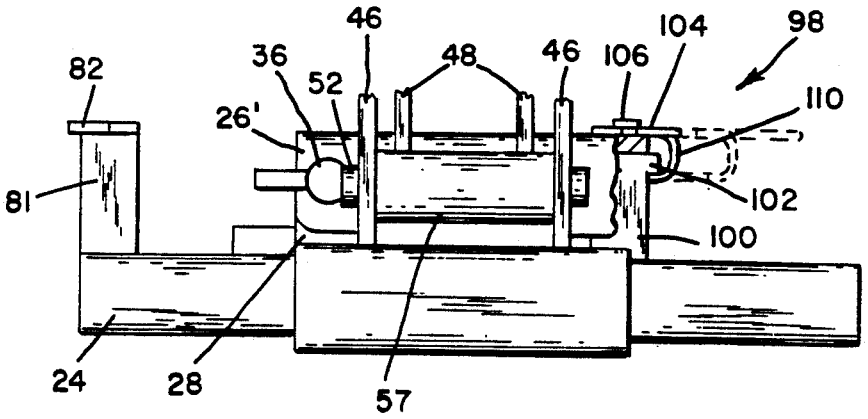
FIG. 11 is a fragmentary front elevational view of the third modified retaining mechanism.

Referring to FIGS. 10 and 11, a third modified first retaining means is generally indicated by the reference numeral 98. The retaining means 98 comprises a bracket 100 which is fixed to the mounting bracket 24 and a locking arm 104 which is pivotally mounted on the connecting bracket 26' by means of a pivot pin 106. The bracket 100 has a lateral projection 102. The locking arm 104 has an L-shaped flange along its outer edge for engaging the projection 102 when the arm 104 is in its locking position as shown by full lines in FIGS. 10 and 11. When the arm 104 is in the locking position, the connecting bracket 26' cannot be pivoted about the pin 36. When the arm 104 is moved to its non-locking position as shown by dotted lines in FIGS. 10 and 11, the flange 110 is clear of the projection 102 and the connecting bracket 26' is free to pivot about the pin 36 for enabling the clamping apparatus to be moved to its storage position.

Minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Material clamping apparatus for use on a pivoted tractor bucket which has an upper edge and a lower edge, said apparatus comprising:

(a) a mounting bracket which is fixed to the upper edge of the bucket, (b) a connecting bracket which is mounted on said mounting bracket for pivoting movement about a horizontal axis which is transverse to said upper edge between a horizontal active position to a vertical inactive position, (c) an elongated clamp arm which is mounted on said connecting bracket for pivoting movement within a vertical plane between an upper non-clamping position to a lower clamping position relative to the lower edge of said bucket when said connecting bracket is in its active position, said elongated arm extending above and parallel to said upper edge when said connecting bracket is in its inactive position and said clamping arm is in said upper non-clamping position relative to said connecting bracket, (d) hydraulic actuating means for selectively moving said clamping arm to either said upper non-clamping position or said lower clamping position, (e) first retaining means for selectively maintaining said connecting bracket in said active position, said first retaining means having a first portion which is fixed to said mounting bracket and a second portion which is movable relative to said first portion for selectively engaging said connecting bracket and for selectively locking said connecting bracket relative to said first portion, the second portion of first retaining means comprising a locking bracket which is pivotally connected to said mounting bracket for pivoting movement between a locking position and an unlocking position, said locking bracket having a retaining finger which is fixed to said locking bracket and which engages said connecting bracket when said locking bracket is in its locking position for preventing said connecting bracket from pivoting about its horizontal pivoting axis, and (f) second retaining means for selectively maintaining said connecting bracket in said inactive position, said second retaining means being fixed to said mounting bracket and spaced from said first retaining means.

2. Material clamping apparatus as recited in claim 1, wherein said locking bracket is biased toward said locking position.

* * * * *